US005222725A

United States Patent [19]

Kasahara et al.

[11] Patent Number: 5,222,725

[45] Date of Patent: Jun. 29, 1993

[54] SHEET FEED MECHANISM OF IMAGE RECORDING APPARATUS

[75] Inventors: Rikio Kasahara; Kenya Komada, both of Yokohama, Japan

[73] Assignee: Ricoh Company, Ltd., Tokyo, Japan

[21] Appl. No.: 798,217

[22] Filed: Nov. 26, 1991

[30] Foreign Application Priority Data

Nov. 29, 1990 [JP] Japan ..... 2-332928

[51] Int. Cl.[5] ..... B65H 1/10

[52] U.S. Cl. ..... 271/160; 271/127

[58] Field of Search ..... 271/127, 157, 160, 162, 271/164

[56] References Cited

U.S. PATENT DOCUMENTS 4,488,718 12/1984 Tamura ..... 271/162 X
5,058,877 10/1991 Fujiwara et al. ..... 271/124

FOREIGN PATENT DOCUMENTS 40156 3/1980 Japan ..... 271/127
140435 11/1980 Japan ..... 271/164
176227 7/1988 Japan ..... 271/127
138026 5/1990 Japan ..... 271/160
295828 12/1990 Japan ..... 271/127

*Primary Examiner*—Robert P. Olszewski
*Assistant Examiner*—Boris Milef
*Attorney, Agent, or Firm*—Cooper & Dunham

[57] ABSTRACT

A sheet feed mechanism of an image recording apparatus comprises a lifter mechanism movable between a first position in engagement with a cassette that holds a sheet thereon and a second position in disengagement with the cassette, a first urging mechanism for urging the lifter mechanism to the first position with a first urging force, a second urging mechanism for urging the lifter mechanism to the second position with a second urging force that acts opposite to the first urging force, and a control mechanism connected the second urging mechanism, wherein the control mechanism is adapted to engage with the cassette when the cassette is mounted on the image recording apparatus for causing a change in the second urging forces depending on whether the cassette is mounted on the image recording apparatus or the cassette is dismounted from the image recording apparatus, such that the second urging force is smaller than the first urging force when the cassette is dismounted from the image recording apparatus and such that the second urging force is larger than the first urging force when the cassette is mounted on the image recording apparatus.

4 Claims, 5 Drawing Sheets

SHEET FEED MECHANISM OF IMAGE RECORDING APPARATUS

BACKGROUND OF THE INVENTION

The present invention generally relates to image recording apparatuses and more particularly to a sheet feed mechanism for use in an image recording apparatus such as a printer, copier, facsimile, or the like. Specifically, the present invention relates to a sheet feed mechanism of an image recording apparatus for use with a cassette that has a movable sheet plate for holding a sheet thereon, wherein the sheet feed mechanism pushes the sheet plate of the cassette in the upward direction to urge the sheet held thereon against a feed roller and for feeding the sheet to the image recording apparatus one by one by driving the feed roller.

FIG. 1 shows a conventional construction of a sheet feed mechanism for use in an image recording apparatus.

Referring to FIG. 1, the sheet feed mechanism is provided inside the body (not shown) of the image recording apparatus and cooperates with a cassette 6 that has a body 6*a*. The sheet feed mechanism includes a rotary shaft 1 held rotatably on the body of the apparatus and carries at both ends thereof a pair of levers 2 and 3. Further, there is provided a central lift arm 4 of which action will be described later. The lever 2 generally has an L-shape wherein a first end thereof is connected to a spring 5 that urges the lever 2 continuously to rotate in the counter-clockwise direction.

The cassette 6, on the other hand, includes a sheet plate 7 on which a stack of sheet P is placed. The plate 7 is hinged to the body 6*a* at an end not shown in FIG. 1 and is movable up and down about the hinge. At the front end of the body 6*a*, there is provided an opening 8 for accepting the arm 4 when the cassette 6 is mounted on the image recording apparatus, and a cam part 9 is formed on the outer surface of both side walls of the body 6*a* to guide the levers 2 and 3.

Upon mounting of the cassette 6 on the recording apparatus, the cam part 9 at both side walls of the cassette body 6*a* is engaged with a projection 2*a* formed at a second, opposite end of the lever 2 as well as with a projection 3*a* that is formed at an end of the lever 3. With further insertion of the cassette 6, the cam part 9 moves the arms 2 and 3 in the clockwise direction and the lift arm 4 is lowered accordingly. Thereby, the lift arm 4 is accepted by the cassette 6 through the opening 8 at the lower side of the sheet plate 7. With further insertion, the arms 2 and 3 are disengaged from the cam part 9 and are rotated in the counter-clockwise direction by the action of the spring 5. It should be noted that the rotation of the arms 2 and 3 can be very fast due to the large urging force exerted by the spring 5. In response to the rotation of the arms 2 and 3, the lift arm 4 pushes the sheet plate 7 strongly in the upward direction by a contact part 4*a* formed at the tip end of the arm 4. As a result, the sheet P held on the plate 7 as a stack is urged firmly against a feed roller (not shown) of the apparatus that is provided above the cassette 6, and the sheet is fed by the feed roller one by one for image recording.

In this conventional sheet feed mechanism, however, there arises a problem that the movable sheet plate 7 may cause a deformation due to the large impact given by the lift arm 4 when it goes up and hits the bottom of the plate 7. Thereby, the sheet held on the plate 7 may cause a corresponding bending. Such a bending of the sheet stack P tends to cause a jamming of the sheet.

SUMMARY OF THE INVENTION

Accordingly, it is a general object of the present invention to provide a novel and useful sheet feed mechanism, wherein the foregoing problems are eliminated.

Another and more specific object of the present invention is to provide a sheet feed mechanism for use in an image recording apparatus, wherein the problem of deformation of a sheet plate that is used in a cassette for holding the sheet thereon and for urging the sheet to a feed roller, is eliminated.

Another object of the present invention is to provide a sheet feed mechanism of an image recording apparatus, said image recording apparatus being mounted with a cassette that holds a stack of sheet therein and recording an image on said sheet by feeding the sheet from said cassette, comprising: lifter means movable between a first position and a second, different position, said lifter means being adapted in engagement with a part of the cassette for feeding the sheet when in said second position, said lifter means being adapted in disengagement from said cassette when in said first position; first urging means for urging the lifter means to said first position with a first urging force; second urging means for urging the lifter means to said second position with a second urging force, said second urging force acting opposite to said first urging force; control means connected said second urging means, said control means being adapted to engage with said cassette when said cassette is mounted on said image recording apparatus for causing a change in the second urging forces depending on whether the cassette is mounted on said image recording apparatus or the cassette is dismounted from said image recording apparatus such that said second urging force is smaller than the first urging force when said cassette is dismounted from said image recording apparatus and such that said second urging force is larger than the first urging force when said cassette is mounted on said image recording apparatus. According to the present invention, the second urging means causes a gradual movement of the lifter means in the upward direction due to the interaction of the first and second urging forces, and the problem of the lifter means hitting the bottom of the sheet plate is eliminated. The lifter means engages with the sheet plate gently at first and then firmly. As a result, the undesirable deformation of the sheet plate of the cassette and hence the bending of the sheet held on the sheet plate is eliminated. Thereby, the problem of the sheet causing jam during feeding is eliminated and a reliable sheet feeding is achieved.

Other objects and further features of the present invention will become apparent from the following detailed description when read in conjunction with the attached drawings.

DETAILED DESCRIPTION

Figure 1:
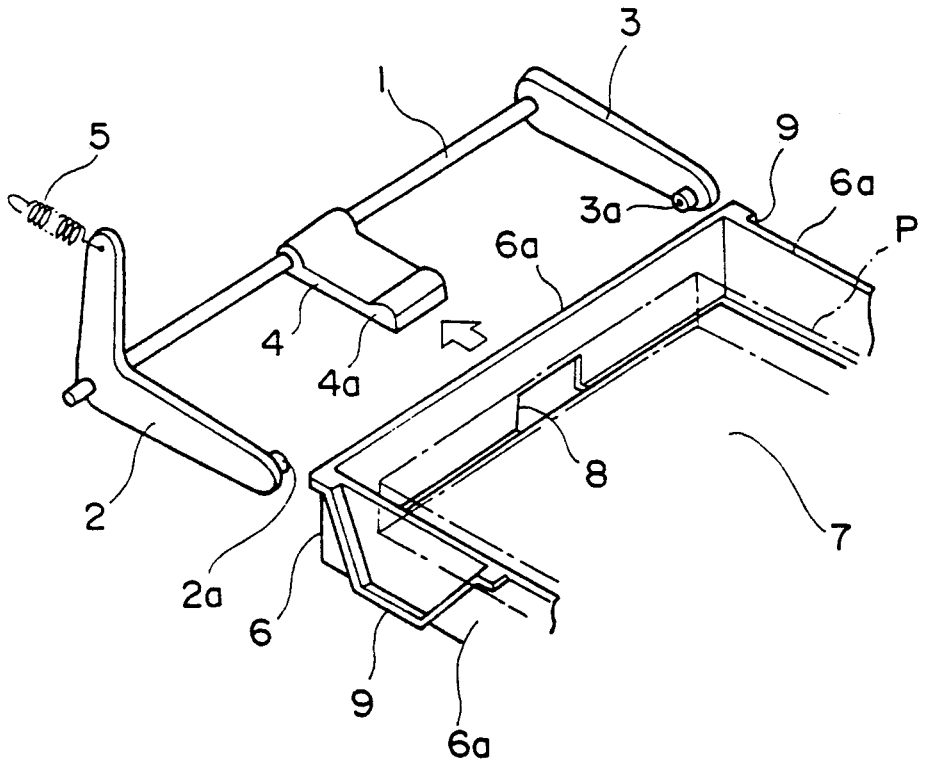
FIG. 1 PRIOR ART
FIG. 1 is a diagram showing a conventional sheet feed mechanism.
Figure 2:
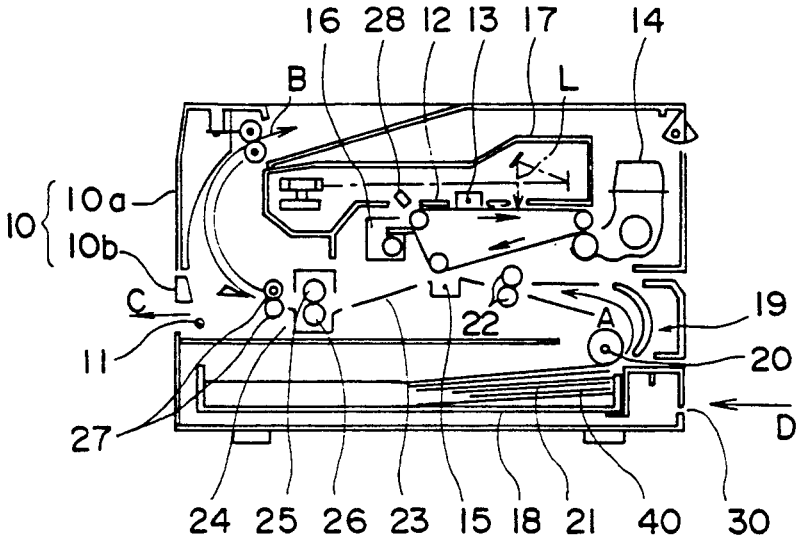
FIG. 2 is a diagram showing the construction of an image recording apparatus that uses the sheet feed mechanism of the present invention.

FIG. 2 shows a laser printer that uses the sheet feed mechanism of the present invention.

Referring to FIG. 2, the laser printer has a body 10 that includes an upper body part 10*a* and a lower body part 10*b*, wherein the upper body part 10*a* is connected to the lower body part 10*b* by a hinge 11. Thereby, the interior of the apparatus 10 is exposed by tilting the upper body part 10*a* against the lower body part 10*b*.

In the interior of the body 10, there is provided a photosensitive belt 12 generally in correspondence to the central part thereof. The photosensitive belt 12 is moved along a circuitous path in the clockwise direction as shown in FIG. 2, and the belt 12 is surrounded by an electrostatic charger 13 for charging the belt 12 uniformly, a developing unit 14 provided at a downstream side of the charger 13 for supplying the toner on the charged belt 12 to form a toner image thereon, an image transfer unit 15 provided at a downstream side of the unit 14 for transferring the toner image on the belt 12 to the sheet, and a cleaning unit 16 provided at a downstream side of the unit 15 for cleaning the toner remaining on the belt 12 after the transfer of the image to the sheet. Above the photosensitive belt 12, there is provided an optical recording unit 17 for writing an image on the photosensitive belt 12 in correspondence to a part located between the charger 13 and the developing unit 14 by a laser beam L as an electrostatic latent image. The foregoing toner image formed by the developing unit 14 is formed in correspondence to the electrostatic latent image thus formed. On the other hand, a sheet cassette 18 for holding a sheet 21 is provided below the belt 12 at a level lower than the transfer unit 15 for feeding the sheet for recording.

The sheet 21 held on the sheet cassette 18 is engaged with a feed roller 20 that separates the sheet from the cassette 18 one by one and feeds the same along a sheet path to a resist roller 22. The resist roller 22 feeds the sheet 21 in synchronization with the photosensitive belt 12 further to an image transfer unit 15 wherein the sheet 21 is contacted with the photosensitive belt 12 and the toner image formed on the belt 12 is transferred to the sheet 21. The sheet 21 thus transferred with the toner image is then transferred along a guide 23 and passed through a pair of rollers 25 and 26 that form a fixing unit 24, wherein the sheet 21 is pressed and heated simultaneously such that the toner image on the sheet is fixed. The sheet 21 is then discharged by a discharge roller in the direction B or direction C. After the transfer of the image, the remaining toner on the photosensitive belt 12 is removed by the cleaning unit 16.

As shown in FIG. 2, the body 10 of the image recording apparatus has an inlet opening 30 for accepting the cassette 18 at the lower body part 10*b*. In the mechanism 19 of which construction is shown in detail in FIG. 3.

Figure 3:
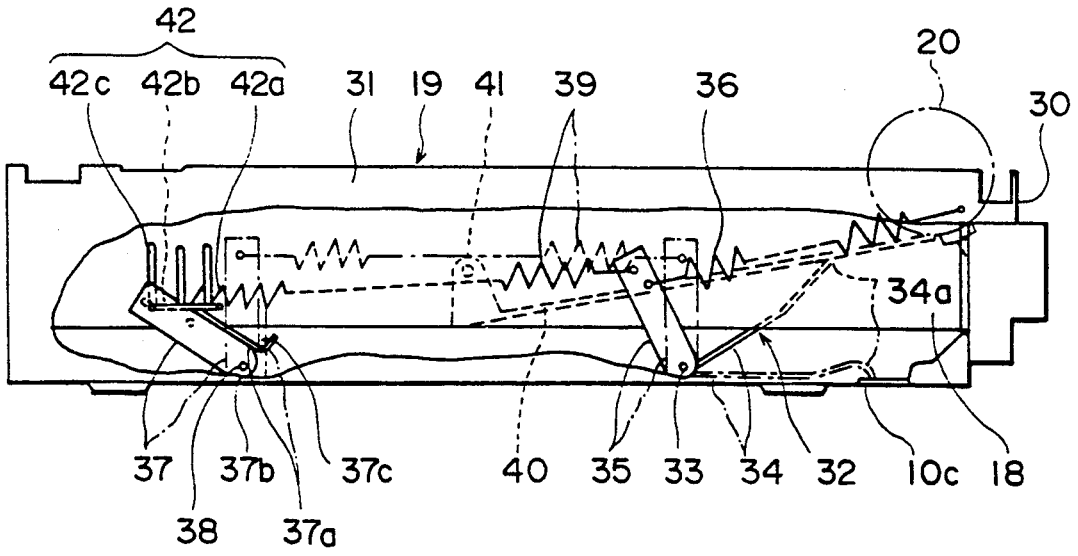
FIG. 3 is a diagram showing the construction of the sheet feed mechanism according to a first embodiment of the present invention.

Referring to FIG. 3 showing the sheet feed mechanism 19 in the state where the cassette 18 is mounted, the sheet feed mechanism 19 includes a lift mechanism 32 provided on the body part 10*b* of the image recording apparatus for engagement with a movable sheet plate 40 of the cassette 18. The lift mechanism 32 includes a lift arm 34 that is carried by a rotary shaft 33 held rotatably by a side wall 31 of the body 10*b* at a part close to the inlet opening 30 and pushes the sheet plate 40 in the upward direction upon actuation. For this purpose, the lift arm 34 is formed with a curved part 34*a* for engagement with the bottom surface of the plate 40. Thereby, a sheet 41 held on the plate 40 as a stack is urged against the feed roller 20. By driving the feed roller 20, the sheet 41 in the stack is fed one by one along the sheet path as already described.

It should be noted that the lift arm 34 has to be in a position away from the cassette 18 when the cassette is mounted or dismounted on and from the apparatus. In order to cause such a movement of the lever 32, there is provided an actuation lever 35 in connection with the rotary shaft 33 and an end of a spring 36 is connected to the lever 35. The spring 36 has another end connected to the side wall 31 at a part located closer to the inlet opening 30 and urges the lever 35 in the clockwise direction. In response to this, the lift lever 34 is urged to the position wherein the lever is disengaged from the cassette 18.

Figure 4:
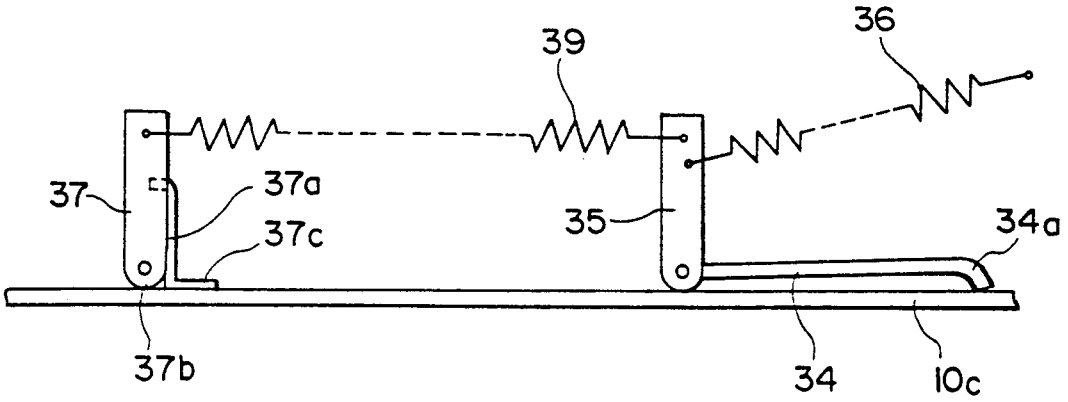
FIG. 4 is a diagram showing the sheet feed mechanism of FIG. 3 in a state wherein a cassette is removed from the apparatus.

Further, in order to urge the lever 35 in the counter-clockwise direction to push the sheet plate 40 upward, another lever 37 is provided at a part away from the inlet opening 30 with respect to the lever 35 in a manner rotatable about a rotary shaft 38 that is held rotatably on the side wall 31. More specifically, the lever 37 has a lower end 37*b* that is connected to the shaft 38, and an abutting member 37*a* is connected to the lever 37. The abutting member 37*a* projects laterally into the space of the apparatus in which the cassette 18 is accepted and engages with a part of the cassette 18 as will be described later when the cassette 18 is mounted. Further, there is provided a stopper part 37*c* at the bottom of the member 37*a* for preventing the lever 37 from being rotated in the clockwise direction form the vertical position. See FIG. 4 that shows the sheet feed mechanism 19 in the sate where the cassette 18 is removed.

Figure 5:
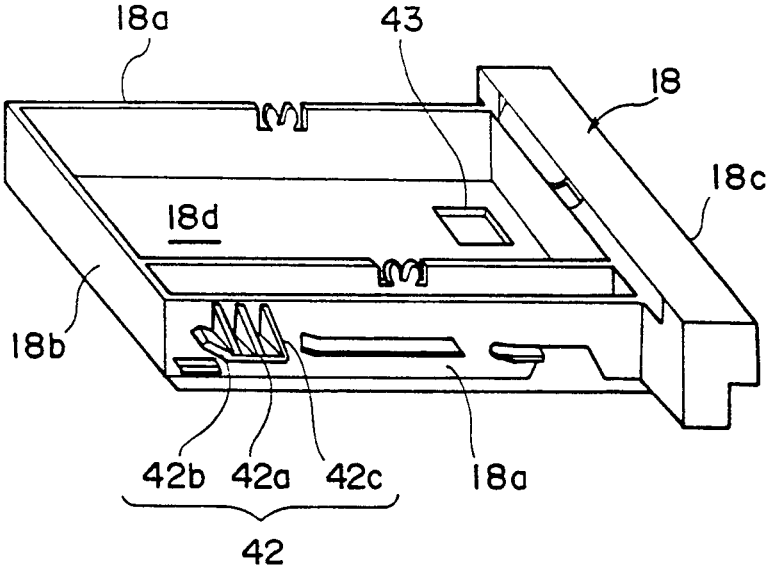
FIG. 5 is a diagram showing the construction of a cassette used in the sheet feed mechanism of FIG. 3 in the perspective view.

The free end of the lever 37 is connected to the free end of the lever 35 by a spring 39 and is urged in the counter-clockwise direction upon insertion of the cassette 18 through the inlet opening 30. In order to actuate the lever 37, the cassette 18 has a cam part 42 formed at both side walls as shown in FIG. 5. When the cassette 18 is removed, on the other hand, the lever 37 rotates in the clockwise direction to a position shown by a dotted line in FIG. 3. It should be noted that the state represented by the dotted line in FIG. 3 corresponds to the state shown in FIG. 4.

Referring to FIG. 5, the cassette 18 includes a pair of opposing side walls 18*a*, a rear wall 18*b*, a front wall 18*c* and a bottom plate 18*d*, wherein a cutout 43 is formed in the bottom wall 18*d* for accepting the lift lever 34. In the cassette 18, the sheet plate 40 is hinged about a pin 41 shown in FIG. 3. Thereby, the plate 40 is moved up and down when the lift arm 34 is engaged thereto through the cutout 43. Further, FIG. 5 shows the cam part 42 at both side walls 18*a*, wherein the cam part 42 includes continuous cam surfaces 42*a* and 42*b* for engagement with the abutting part 37*a* of the lever 37. The cam surfaces 42*a* and 42*b* are reinforced by ribs 42*c*.

Referring to FIG. 4 again, it will be noted that the lift arm 34 is urged in the clockwise direction to the retracted position by the spring 36 while being urged simultaneously by the spring 39 in the counterclockwise direction. Thereby, it will be understood that the force exerted by the spring 39 is set smaller than the force exerted by the spring 36. Otherwise, the lever 35 and hence the arm 34 are moved in the counter-clockwise direction by the spring 39. In other words, the stiffness of the spring 36 is set larger than the stiffness of the spring 39. Because of the setting of the stiffness of the springs 36 and 39 as set forth above, the sheet feed mechanism 19 of the present invention provides a gentle urging force for the lift lever 34 while using a spring having a large stiffness for the return spring 36.

Figure 6:
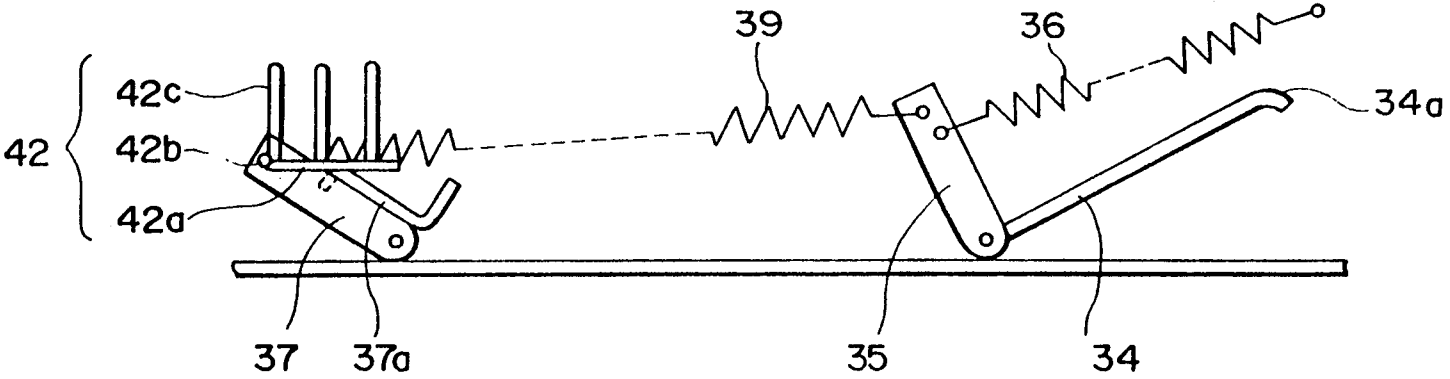
FIG. 6 is a diagram showing the sheet feed mechanism of FIG. 3 in a state wherein a cassette is mounted on the apparatus.

FIG. 6 shows the state wherein the cassette 18 is inserted into the image recording apparatus. Thereby, the cam part 42 of the cassette 18 urges the lever 37 in the counter-clockwise direction and both springs 36 and 39 cause extension, wherein the magnitude of the extension is much larger in the spring 39 than in the spring 36 at the beginning of insertion. In this state, the lift arm 34 moves little. In the meantime, the force exerted by the spring 39 exceeds the force exerted by the spring 36 because of the large extension of the spring 39, and the arm 34 is moved gently in the counter-clockwise direction. Thereby, the sheet plate 40 is pushed gently in the upward direction and the sheet held on the plate 40 is engaged with the feed roller 20. As the force applied to the plate 40 is reduced in the present invention, the problem of deformation of the plate 40 is eliminated and the reliability increases in the sheet feeding. When the cassette 18 is inserted fully into the apparatus, the arm 34 engages with the plate 40 firmly. As long as the cassette 18 is mounted on the image recording apparatus, the cam surface 42*a* holds the lever 37 and the lift arm 34 continues urging the plate 40 in the upward direction.

When dismounting the cassette 18, the engagement between the lever 37 and the cam surface 42*a* or 42*b* is canceled and the lever 37 starts to rotate in the clockwise direction. With further rotation of the lever 37, the force of the spring 36 increases gradually and the spring 39 shrinks accordingly. As a result, the lever 35 is returned to the vertical position shown in FIG. 4. In correspondence thereto, the lift arm 34 is moved to the retracted position and the sheet plate 40 is lowered by the gravity to the position coincident to the bottom plate 18*d* of the cassette.

Next, a second embodiment of the present invention will be described with reference to FIG. 7.

Figure 7:
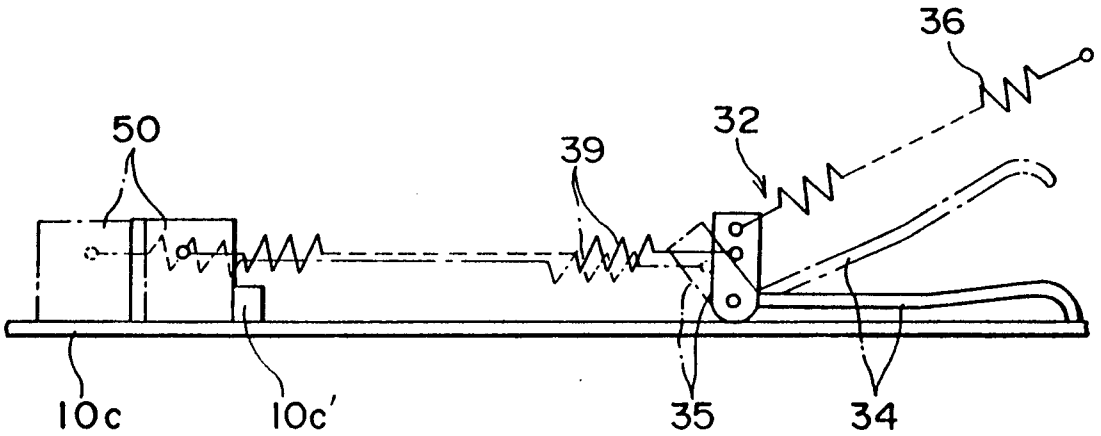
FIG. 7 is a diagram showing a second embodiment of the present invention.

Referring to FIG. 7, the present embodiment employs a slider 50 in place of the lever 37 to cause the movement of the lever 35 and hence the arm 34. The slider 50 is moved on the top surface of a bottom plate 10*c* of the body 10 of the image recording apparatus between the position shown by the broken line in FIG. 7 and the position shown by the continuous line. In order to limit the slide movement of the slider 50, a stopper 10*c*′ is formed on the bottom plate 10*c*.

As will be seen in FIG. 7, the spring 39 is now connected between the lever 35 and the slider 50. Upon the insertion of the cassette 18 into the apparatus, the projecting cam part 42 of the cassette 18 pushes the slider 50 to the position shown by the broken line. In response to this, the lift arm 34 is moved upward similar to the first embodiment as shown by the broken line and the sheet held on the plate 40 is urged against the feed roller 20 gently. When the cassette 18 is removed, on the other hand, the slider 50 returns to the position shown by the continuous line and the lift arm 34 is lowered.

Figure 8:
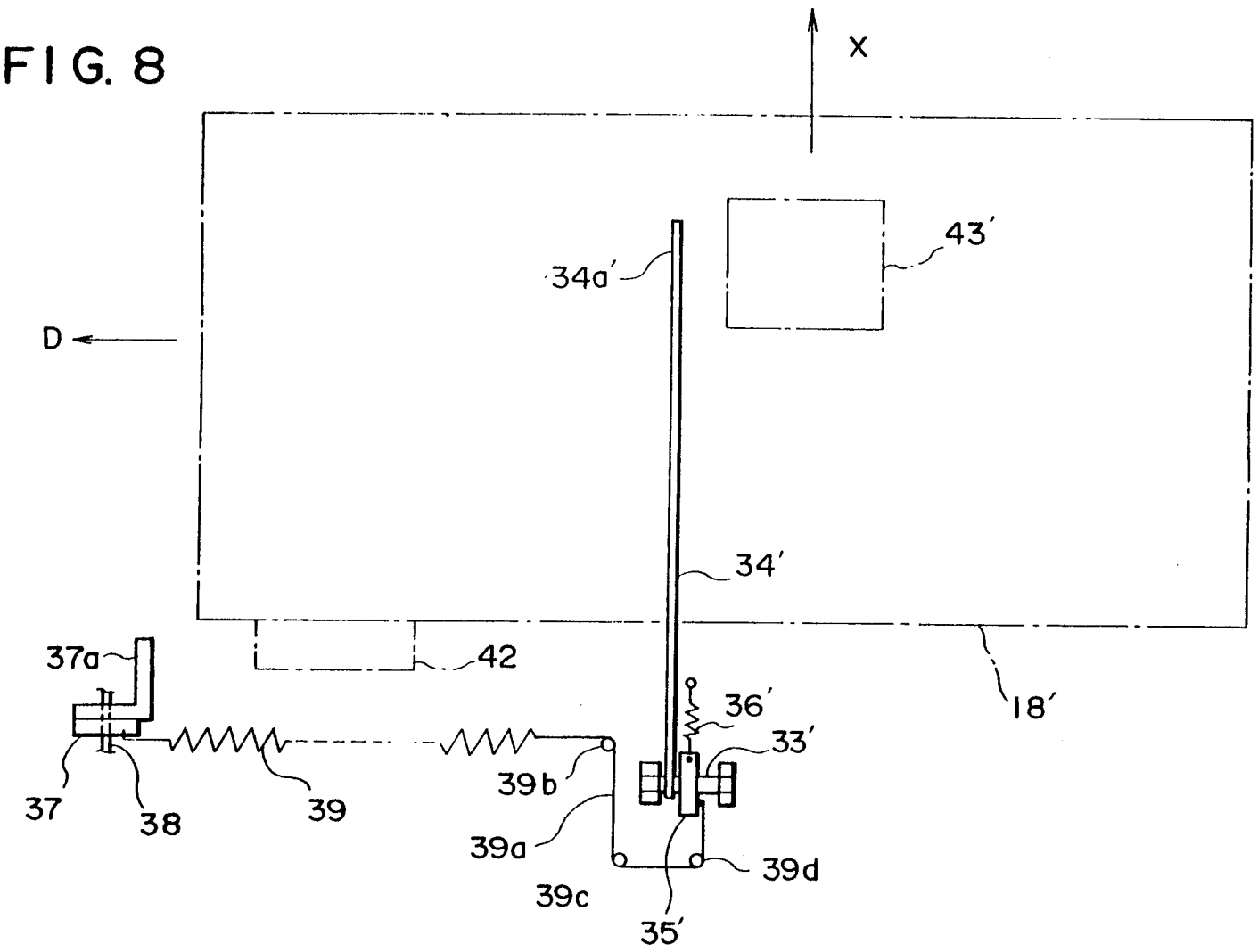
FIG. 8 is a diagram showing a third embodiment of the present invention.

FIG. 8 shows a third embodiment of the present invention.

In the present embodiment, a cassette 18′ is used in place of the cassette 18, wherein the cassette 18′ is inserted in the direction D similar to the apparatus of FIG. 2 while the sheet is fed in the direction X that is substantially perpendicular to the direction D. In correspondence to this, there is provided a cutout 43′ for accommodating the lift arm at a part close to the side of the cassette 18′ through which the sheet is fed.

In order to press the sheet plate 40 in correspondence to the cutout 43′, the present embodiment employs a lever 35′ that is held rotatable about a pin 33′ within the plane perpendicular to the direction D, and a wire 39*a* is connected to the lever 35′ to cause the rotational movement of the lever 35′. The wire 39*a* is connected to the spring 39 and is guided by a guide mechanism 39*b*, 39*c* and 39*d* to pull the lever in the X direction. On the pin 33′, a lift arm 34′ is fixed and the arm 34′ is lifted when the wire 39*a* is pulled by the spring 39 in response to the insertion of the cassette 18′. In response thereto, a tip end part 34*a*′ corresponding to the part 34*a* is engaged with the bottom surface of the sheet plate 40 and the sheet held on the plate 40 is urged against the feed roller 20 that now extends in the direction D.

The lever 35′ is further urged in the opposite direction by a spring 36′ that corresponds to the spring 36, and is returned to the upright position upon the removal of the cassette 18′ from the apparatus. Thereby, the arm 34′ is lowered to the retracted position and the removal of the cassette 18′ is made without being obstructed by the arm 34′.

Further, the present invention is not limited to the embodiments described heretofore, but various variations and modifications may be made without departing from the scope of the invention.

What is claimed is:

1. A sheet feed mechanism of an image recording apparatus, said image recording apparatus being mounted with a cassette that holds a stack of sheets therein and recording an image on a sheet by feeding the sheet from said cassette, comprising:

lifter means movable between a first position and a second, different position and comprising an arm connected to a first shaft in a manner movable about said first shaft between said first position and said second position and a first lever connected to said first shaft for causing a movement of said arm between said first position and said second position;, said lifter means being adapted in engagement with a part of the cassette for feeding the sheet when in said second position; said lifter means being adapted in disengagement from said cassette when in said first position;

first urging means for urging the lifter means to said first position with a first urging force comprising a first spring connected to said first lever for urging the same in a first direction that is selected to cause the movement of said arm to said first position, said first spring exerting said first urging force;

second urging means comprising a second spring having an end connected to said first lever for urging the same in a second, opposition direction that is selected to cause the movement of said arm to said second position for urging the lifter means to said second position with a second urging force, said second urging force acting opposite to said first urging force;

control means connected to said second urging means, said control means being adapted to engage with said cassette when said cassette is mounted on said image recording apparatus for causing a change in the second urging force depending on whether the cassette is mounted on said image recording apparatus or the cassette is dismounted from said image recording apparatus such that said second urging force is smaller than the first urging force when said cassette is dismounted from said image recording apparatus and such that said second urging force is larger than the first urging force when said cassette is mounted on said image recording apparatus;

said control means comprising a second lever connected to a second shaft in a manner movable about said second shaft between a third position and a fourth position, said second lever being adapted to make an engagement with said cassette when said cassette is mounted on said image recording apparatus said second lever being connected to a second, opposing end of said second spring and urged to said third position when said cassette is dismounted from said image recording apparatus, said second lever being urged to set fourth position when said cassette is mounted on said image recording apparatus.

2. A sheet feed mechanism as claimed in claim 1, in which said cassette is inserted into said image recording apparatus in a predetermined direction, said sheet being removed for feeding in a direction opposite to said predetermined direction, wherein said first shaft extends in a direction substantially perpendicular to said predetermined direction.

3. A sheet feed mechanism as claimed in claim 1, in which said cassette is inserted into said image recording apparatus in a predetermined direction, said sheet being removed for feeding in a direction substantially perpendicular to said predetermined direction, wherein said first shaft extends in a direction substantially parallel to said predetermined direction.

4. An image recording system for recording an image on a sheet, comprising:

a sheet cassette for holding a sheet therein, said sheet cassette including a sheet plate that holds said sheet thereon; and an image recording apparatus adapted to be mounted with said sheet cassette and comprising a sheet feed mechanism for picking up a sheet from said sheet cassette and image recording means for recording an image on said sheet, said sheet feed mechanism comprising lifter means movable between a first position and a second, different position, said lifter means being adapted in engagement with a plate of the cassette that holds a sheet on said plate when in the second position; said lifter means being adapted in disengagement with said plate when in the first position; first urging means for urging the lifter means to said first position with a first urging force; second urging means for urging the lifter means to said second position with a second urging force, said second urging force acting opposite to said first urging force; control means connected said second urging means, said control means being adapted to engage with said cassette when said cassette is mounted on said image recording apparatus for causing a change in the second urging force depending on whether the cassette is mounted on said image recording apparatus or the cassette is dismounted from said image recording apparatus such that said second urging force is smaller than the first urging force when said cassette is dismounted from said image recording apparatus and such that said second urging force is larger than the first urging force when said cassette is mounted on said image recording apparatus; said sheet cassette having a cam part for engagement with said control means;

said lifter means comprising an arm connected to a first shaft in a manner movable about said first shaft between said first position and said second position and a first lever connected to said first shaft for causing a movement of said arm between said first position and said second position;

said first urging means comprising a first spring connected to said first lever for urging the same in a first direction that is selected to cause the movement of said arm to said first position, said first spring exerting said first urging force; and said second urging means comprises a second spring having an end connected to said first lever for urging the same in a second, opposite direction that is selected to cause the movement of said arm to said second position, said second spring exerting said second urging force;

said control means comprising a second lever connected to a second shaft in a manner movable about said second shaft between a third position and a fourth position, said second lever being adapted to make an engagement with said cassette when said cassette is mounted on said image recording apparatus said second lever being connected to a second, opposing end of said second spring and urged to said third position when said cassette is dismounted from said image recording apparatus, said second lever being urged to said fourth position when said cassette is mounted on said image recording apparatus.

* * * * *